US008715099B2

(12) United States Patent
Dawson et al.

(10) Patent No.: US 8,715,099 B2
(45) Date of Patent: May 6, 2014

(54) BACKSWING TRAINING DEVICE

(71) Applicant: Davinci Sports International, Inc., Fort Lauderdale, FL (US)

(72) Inventors: Dale A Dawson, Davie, FL (US); Warren Bottke, Palm Beach Gardens, FL (US); Alan Kleinman, Davie, FL (US)

(73) Assignee: Davinci Sports International, Inc., Fort Lauderdale, FL (US)

( * ) Notice: Subject to any disclaimer, the term of this patent is extended or adjusted under 35 U.S.C. 154(b) by 0 days.

(21) Appl. No.: 13/959,343

(22) Filed: Aug. 5, 2013

(65) Prior Publication Data

US 2014/0045603 A1 Feb. 13, 2014

Related U.S. Application Data

(60) Provisional application No. 61/680,540, filed on Aug. 7, 2012.

(51) Int. Cl.
*A63B 69/36* (2006.01)

(52) U.S. Cl.
USPC ..... 473/257; 473/265

(58) Field of Classification Search
USPC ..... 473/218, 219, 257, 261, 264–266, 270, 473/278
See application file for complete search history.

(56) References Cited

U.S. PATENT DOCUMENTS

| | | | | | |
|---|---|---|---|---|---|
| 3,244,421 | A | * | 4/1966 | Hanna | 473/273 |
| 4,344,624 | A | * | 8/1982 | Laursen | 473/159 |
| 4,563,010 | A | * | 1/1986 | McDorman et al. | 473/267 |
| 5,014,994 | A | * | 5/1991 | Peters | 473/218 |
| 5,301,949 | A | * | 4/1994 | Aupied | 473/265 |
| 5,409,231 | A | * | 4/1995 | Kueng et al. | 473/261 |
| 5,482,284 | A | * | 1/1996 | Vandever | 473/218 |
| 5,976,026 | A | * | 11/1999 | Erb | 473/272 |

* cited by examiner

*Primary Examiner* — Nini Legesse
(74) *Attorney, Agent, or Firm* — Christopher & Weisberg, P.A.

(57) ABSTRACT

A golf backswing training device. The device includes a first elongate portion defining a first major axis. A second elongate portion slideably engageable with the first elongate portion is included, the second elongate portion defining a second major axis, a first end, and a second end. A club alignment element coupled to the first end of the second elongate portion is included, the club alignment element having a first club contact surface disposed at an acute angle with respect to the second major axis.

20 Claims, 6 Drawing Sheets

BACKSWING TRAINING DEVICE

CROSS-REFERENCE TO RELATED APPLICATION

This application is related to and claims priority to U.S. Provisional Patent Application Ser. No. 61/680,540, filed Aug. 7, 2012, entitled SPORTS TRAINING DEVICE AND SYSTEM, the entirety of which is incorporated herein by reference.

STATEMENT REGARDING FEDERALLY SPONSORED RESEARCH OR DEVELOPMENT n/a

FIELD OF THE INVENTION

The present invention relates to a sports training device, and in particular, a golf backswing training device and method of use thereof.

BACKGROUND OF THE INVENTION

A proper golf swing, in which the object is to contact a golf ball, is paramount for success in golf. A proper golf swing, however, is not simple—many different muscles and forces are involved that depend on biomechanics and physics to achieve a desired swing. However, no one athlete has the same body type, and different athletes have different relative strengths and weakness that contribute to a particular motion during a golf swing. Certain aspects of a proper golf swing require certain body movements and club orientations to achieve the proper swing. For example, in a golf backswing it is important to keep the club head down toward the ground and the club head face oriented to the proper face angle. To improve on these aspects of a proper swing, building muscle memory through repetition of a proper backswing is important.

Current sports training devices designed to affect an athlete's swing, however, focus on a single aspect of the swing rather than the entire range of motion. For example, current devices may target one muscle or one specific movement among the many muscles and movements involved in a swing. Thus, current devices may over train certain muscles and under train others, and thus are not particularly effective at training the athlete at the particular aspects of a proper golf backswing based on the athlete's own body mechanics.

SUMMARY OF THE INVENTION

The present invention advantageously provides a golf backswing training device. According to one aspect, the device includes a first elongate portion defining a first major axis. A second elongate portion slideably engageable with the first elongate portion is included, the second elongate portion defining a second major axis, a first end, and a second end. A club alignment element coupled to the first end of the second elongate portion is included, the club alignment element having a first club contact surface disposed at an acute angle with respect to the second major axis.

In another embodiment, a golf backswing training device includes a first elongate portion defining a passage therein, a first major axis, a first end, and a second end. A second elongate portion slideably receivable within the interior of the first elongate portion is included, the second portion defining a first end, a second end, and a second major axis substantially co-axial with the first major axis when the second elongate portion is receive within the passage. A club alignment element movably coupled to the first end of the second elongate portion is included, the club alignment element including a first contact surface disposed at an acute angle with respect to the second major axis. The second portion is slideable from a first position in which the club alignment element is a distance away from the first end of first elongate portion to a second position in which the club alignment element is adjacent the first end of the first elongate portion.

In yet another embodiment, a golf backswing training device includes a first elongate portion defining a first major axis, a first end, a second end, and a passage therein. A second elongate portion slideably receivable within the passage is included, the second portion defining a first end, a second end, and a second major axis substantially co-axial with the first major axis when the second elongate portion is receive within the passage. A club alignment element rotatably coupled to the first end of the second elongate portion is included, the club alignment element being lockingly rotatable about an arcuate path, the club alignment element including a first club contact surface extending disposed at an acute angle with respect to the second major axis. The club alignment element further includes a second club contact surface extending longitudinally from the first club contact surface, the second club contact surface defining a longitudinal axis substantially parallel to the first major axis and the second major axis. The second portion is slideable from a first position in which the club alignment element is a distance away from the first end of first elongate portion to a second position in which the club alignment element is adjacent the first end of the first elongate portion. A support element coupled to the first elongate portion is included, the support element being adjustable in height.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
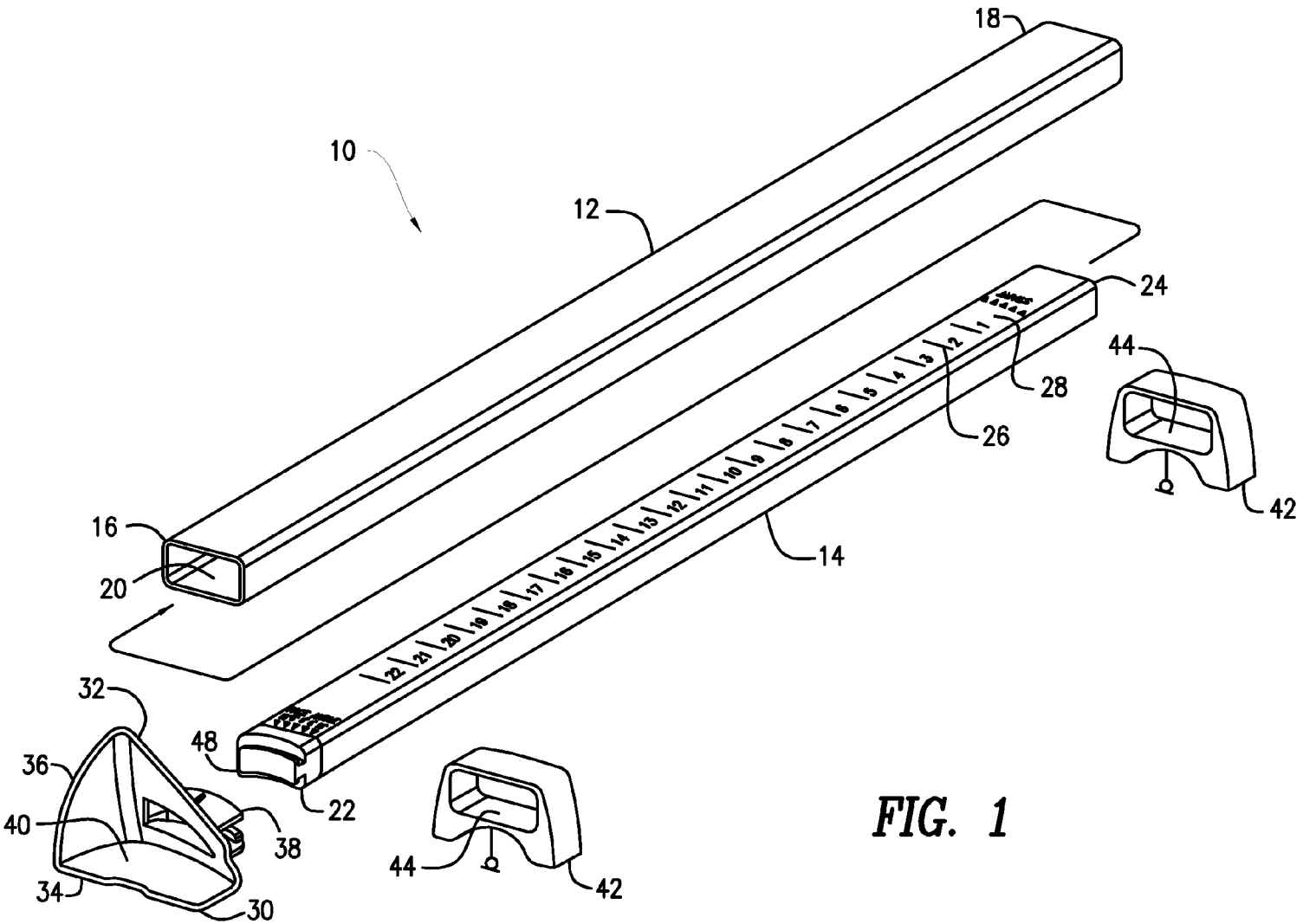
FIG. 1 is an exploded view of an embodiment of a golf backswing training device constructed in accordance with the principles of the present invention.

Now referring to the drawings in which like reference designators refer to like elements, there is shown in the drawings a golf backswing training device constructed in accordance with the principles of the present invention and designated generally as "10." The device 10 may include a first elongate portion 12 and a second elongate portion 14 slideable with respect to the first elongate portion 12. In particular, the first elongate portion 12 may define a first end 16, a second end 18, and a passage 20 there through sized to slideably receive the second elongate portion 14. The passage 20 may span the entire length of the first elongate portion 12 from the first end 16 to the second end 18 or any portion of the length of the first elongate portion 12 thereof. For example, the passage 20 may extend half the length of the first elongate portion 12, such that half of the first elongate portion 12 is hollow, while the remaining half of the first elongate portion 12 may be solid. Alternatively, although not shown in the drawings, the second elongate portion 14 may slide with respect to the first elongate portion 12 by a rail system disposed within the passage 20, or by a plurality of rollers or wheels disposed on the first elongate portion 12, such that the second elongate portion 12 slides on top of, adjacent to, or otherwise proximate to the first elongate portion 12.

In an exemplary configuration, the first elongate portion 12 is at least substantially rectangular in shape. In other configurations, the first elongate portion 12 may be any shape such that it defines a passage 20 therein. For example, the first elongate portion 12 may define a substantially pyramidal or trapezoidal shape any may include one or more curved or substantially planar surfaces. The first elongate portion 12 may be composed of any material on its exterior surface, for example, a smooth material such as aluminum or plastic or alternatively a soft material such as rubber, while the passage 20 is composed of a material having a low coefficient of friction such as aluminum. In an exemplary configuration, the first elongate portion 12 is composed entirely of aluminum.

The second elongate portion 14 includes a first end 22 and a second end 24 and may be substantially solid or hollow. The second elongate portion 14 may be substantially commensurate in length as the first elongate portion 12 or may be shorter or longer in length. For example, the length of the second elongate portion 14 may vary depending on the length of the passage 20. In an exemplary configuration, the width and/or diameter of the second elongate portion 14 is less than the width and/or diameter of the first elongate portion 12, such that the second elongate portion 14 may be slideably received within the passage 20. For example, the first elongate portion 12 may be substantially rectangular in shape, and similarly, the second elongate portion 14 may be substantially rectangular in shape with a height and width less than the height and width of the first elongate portion 12 and co-axial with the first elongate portion 12 when disposed within the passage 20 to facilitate the sliding of the second elongate portion 14 within the first elongate portion 12. Optionally, a material having a low coefficient of friction may be included on the exterior surface of the second elongate portion 14. When the second elongate portion 14 is inserted within the passage 16, the material having a low coefficient of friction may be in contact with the interior of the first elongate portion 12 to provide for a smoother sliding surface. In other configurations (not shown), a rail may be included within the passage 20 to facilitate the sliding of the second elongate portion 14 with respect to the first elongate portion 14.

The second elongate portion 14 may optionally include a plurality of indicia, such as distance markers 26 on at least a portion of a top surface 28 of the second elongate portion 14. The distance markers 26 operate to indicate the displacement of the second elongate portion 14 with respect to the first elongate portion 12. For example, in the configuration shown in FIG. 1, the distance markers are printed, etched, or otherwise provided on the top surface 28 of the second elongate portion 14 in inches starting from 1 inch to 22 inches. When the second elongate portion 14 is fully extended from the first elongate portion 12 such that the first end 22 of the second elongate portion 14 is the furthest distance away from the first end 16 of the first elongate portion 12, all 22 distance markers 26 are visible on the top surface 28 of the second elongate portion 14. As the second elongate portion 14 is slid within the first elongate portion 12 a distance based in part on the force applied on the second elongate portion 14, a number of distance marks 26 may be concealed within the first elongate portion 12, which will indicate the displacement of the second elongate portion 14.

Continuing to refer to FIG. 1, a club alignment element 30 is movably coupled or otherwise affixed to the first end 22 of the second elongate portion 14. The club alignment element 30 may be sized to receive a golf club head, for example, irons varying in loft from lob wedge to a 3 iron. The club alignment element 30 may include a first club contact surface 32, a second club contact surface 34, a sidewall 36, and a coupling member 38. The first club contact surface 32, the second club contact surface 34, and the sidewall 36 may cooperate to define a cavity 40, which is sized to receive the club head of a golf club, as discussed in more detail below. The club alignment element 30 may be composed of the same material as the first elongate portion 12 or the second elongate portion 14, or alternatively may be composed of a different material. For example, the first elongate portion 12 and the second elongate portion 14 may both be composed of aluminum and the club alignment element 30 may be composed of a plastic, such as polycarbonate, or may be coated with a softer durometer material such as silicon to protect the club head.

One or more support elements 42 may be affixed or removeably engageable to the first elongate portion 12 or the second elongate portion 14. For example, the support elements 42 may define an opening 44 sized to engage the first end 16 and/or the second end 18. The support elements 42 may operate to provide a level surface on which the second elongate member 14 may slide with respect to the first elongate member 12. For example, a golfer may use the device 10 on an uneven surface, such as the rough or fairway of a golf course. The support elements 42 operate to provide a level surface such that the device 10 may be used on any surface. Moreover, the support elements 42 may further be adjustable in height. For example, the support elements 42 may include one or more adjustment elements 46, such as a screw with a substantially planar surface, or other element, that creates a distance in height between the support elements 42 and the surface upon which the support elements 42 rests such as the ground. The adjustment elements 46 may be included on any portion of the support elements 42, for example, between first elongate portion 12 and the support elements 42 to space the support elements 42 a distance away from the first elongate portion 42 while maintaining the level surface the support elements 42 may provide.

Figure 2:
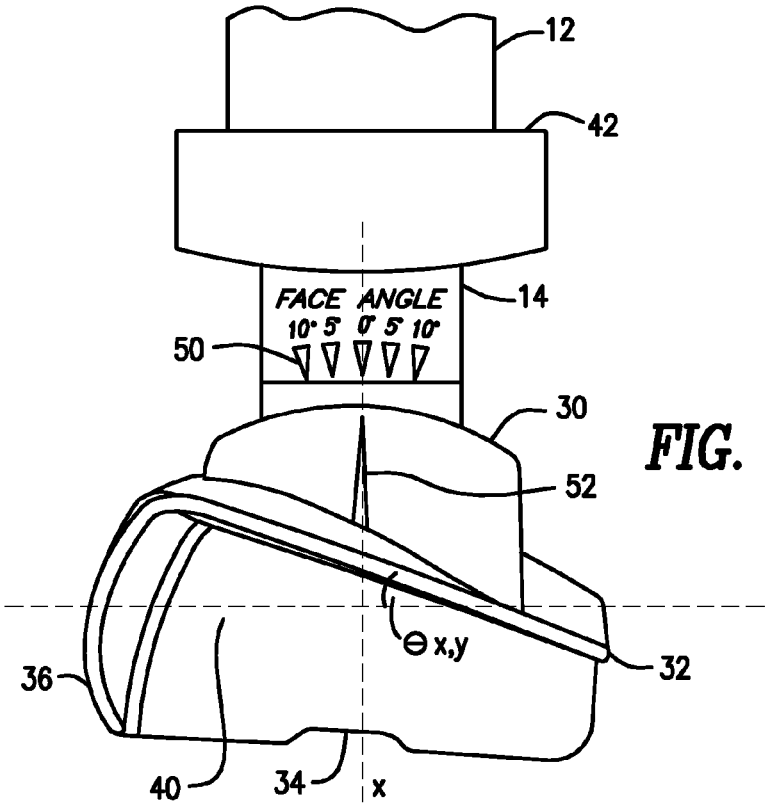
FIG. 2 is a top view of the club alignment element shown in FIG. 1 orientated to have a zero degree club face angle.
Figure 3:
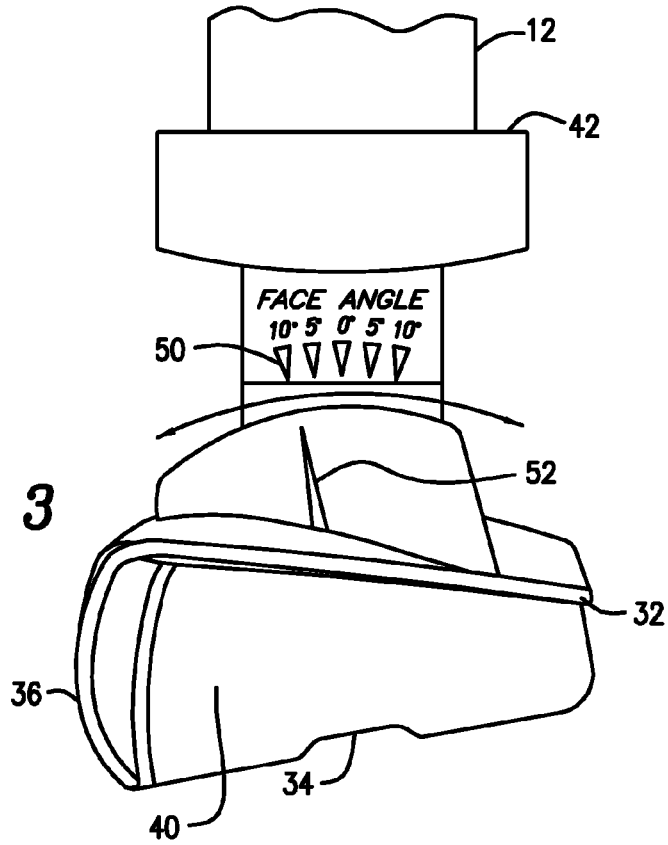
FIG. 3 is a top view of the club alignment element shown in FIG. 2 rotated to a position in which the club face angle is 10 degrees.

Referring now to FIGS. 2 and 3, the club alignment element 30 may be rotatable or otherwise movable along an arcuate path with respect to the second elongate portion 14. In particular, second elongate portion 14 may define a track 48 (best seen in FIG. 6) moveably engageable with the coupling member 38, such that the club alignment element 30 rotates elongate an arcuate path about an axis normal to the major axis defined by the second elongate portion 14. The ability of the club alignment element 30 to rotate about the second elongate portion 14 enables the golfer to adjust the club face angle of the particular club head to a desired angle relative to a center line. In particular, the second elongate portion 14 may include indicia 50 to indicate the face angle of the club relative to a 0 degree center line. For example, the indicia 50 may be indicated in degrees, for example, 0, 5, and 10 to indicate the face angle of the club when the club alignment element 30 is rotated to that particular angle. The club alignment element 30 may further include a marker 52, such a needle to indicate when the club alignment element 30 has been rotated to a desired face angle. For example, as shown in FIG. 3, the club alignment element 30 is rotated counterclockwise to a face angle of 10 degrees left of center. To secure the club alignment element 30 at the selected face angle, the track 48 or the coupling member 38 may optionally include one or more detents or other locking elements (not shown) to lockingly secure the club alignment element 30 at the desired face angle while allowing the club alignment element 30 to rotate to a different face angle with the application of a force.

Continuing to refer to FIGS. 2 and 3, the first club contact surface 32 may be disposed at one or more acute angles relative to the second elongate portion 14. For example, as shown in FIG. 2, the first club contact surface 32 is disposed at an acute angle relative to an axis lateral to the major axis defined by the second elongate portion 14. In particular, the angle $\theta_{x,y}$ shown in FIG. 2, is an exemplary the angle defined by the first contact surface 32 with the major axis ("x") and the lateral axis ("y") when the club alignment element 30 is disposed at a 0 degree face angle. In the embodiment shown in FIG. 2, the angle $\theta_{x,y}$ is approximately 30 degrees and may be any acute angle depending on the face angle the club alignment element 30 defines with the second elongate portion 14. The first contact surface 32 defining the angle $\theta_{x,y}$ is constructed to provide for a flush contact surface between the back of the club head and the first contact surface 32 to properly align the particular club. For example, golf irons may include a loft angle to facilitate providing lift to a golf ball when the club head strikes the golf ball. The loft of the club may vary from club to club, but the every club with the exception of a putter, has a loft greater than 0 degrees. In the embodiment shown in FIG. 2, the angle $\theta_{x,y}$ is approximately 30 degrees such that at least a portion of the club head of a 7 iron is substantially flush with the first contact surface 32 when the club head is positioned within the club alignment element 30.

Continuing to refer to FIGS. 2 and 3, a sidewall 36 may be connected to the first club contact surface 32, which may define a concave shape or a flat shape. The sidewall 36 prevents the golf club head from extending in the direction of the lateral axis away from the golfer when aligned for a golf swing. The sidewall 36 may further define a concavity to match a convexity of a club head to provide a snug fit with the club head. The club alignment element 30 may further define a second club contact surface 34. The second club contact surface 34 may be connected to both the first club contact surface 32 and the sidewall 36 and may define a substantially planar surface. For example, as shown in FIG. 1, the second club contact surface 34 may be substantially parallel to the top surface 28 of the second elongate portion 14. The second club contact surface 24 may operate to provide surface upon which the club head my rest on preparation for a swing. The second club contact surface 34 may also be sized such that a golf ball and the club head may rest against second club contact surface 34 simultaneously within the cavity 40.

Figure 4:
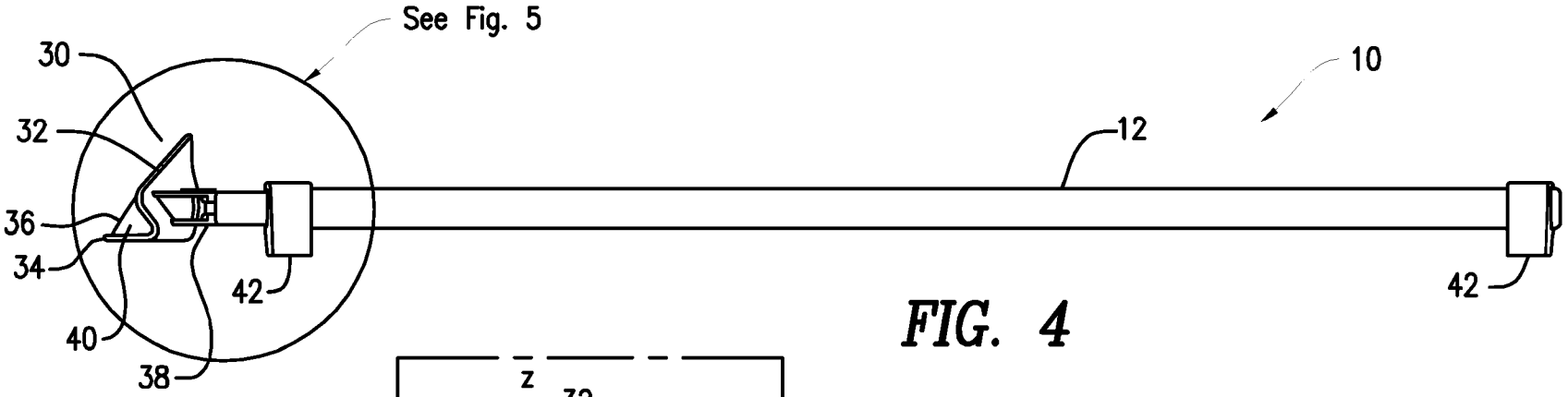
FIG. 4 is a side view of the assembled golf backswing training device shown in FIG. 1.
Figure 5:
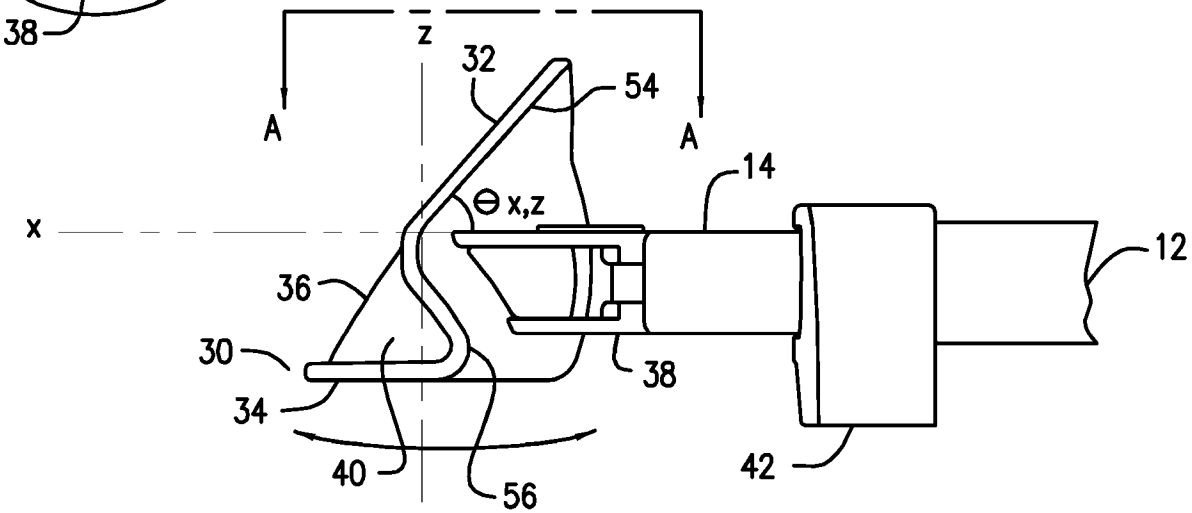
FIG. 5 is a zoomed in view of the club alignment element shown in FIG. 4.

Referring now to FIGS. 4 and 5, in addition to defining an acute angle with the lateral axis ("y"), the first club contact surface 32 may also define an acute angle with an axis normal to the major axis ("x") defined by the second elongate portion 14. For example, as shown in FIG. 5, the first club contact surface 32 may be angled toward the first end 22 of the second elongate portion 14 to at least substantially conform to the curvature of a club head. The angle $\theta_{x,z}$ shown in FIG. 5 is defined as the angle between the major axis ("x") defined by the second elongate portion 14 and the normal axis ("z"). The angle $\theta_{x,z}$ may be any acute angle, but in an exemplary configuration the angle $\theta_{x,z}$ is approximately 45 degrees. The first club contact surface 32 may further define a substantially flat portion 54 and a curved portion 56. The substantially flat portion 54 may be disposed on the upper portion of the first club contact surface 32 and the curved portion 56 may connect the substantially flat portion 54 to the second club contact surface 34. The substantially flat portion 54 may be sloped downward from a first position in which it joins with the sidewall 35 to a second position on the opposite side of the sidewall 36. The downward slope of the substantially flat portion 54 may contour or otherwise be commensurate in shape to that of the club head. The curved portion 56 may be sized to allow the shaft of a golf club to be received within the curved portion 56 when the club head is pressed against the substantially flat portion 54 to provide a flush fit with the club head.

Figure 6:
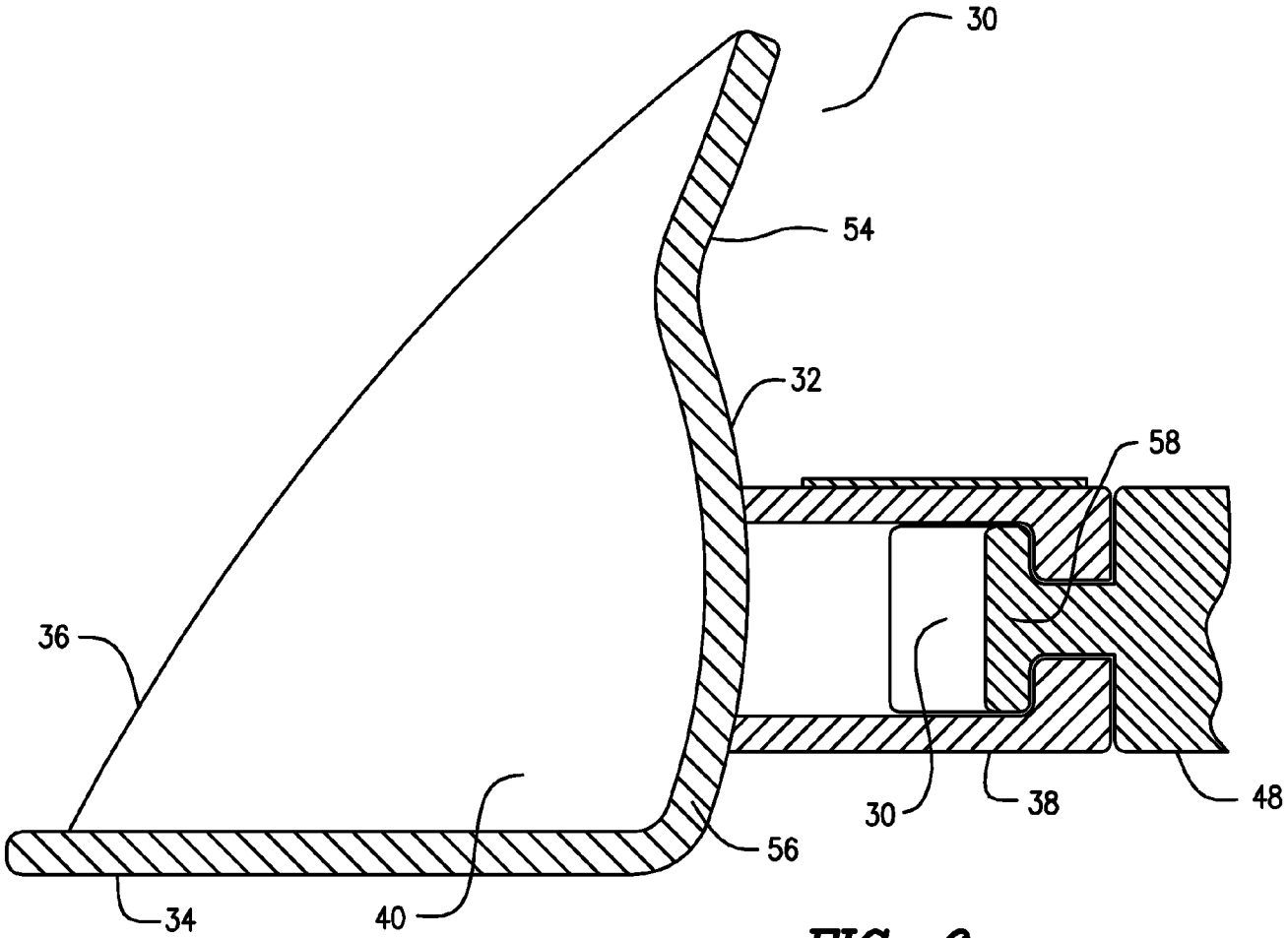
FIG. 6 is a side cross-sectional view across section A-A shown in FIG. 5.

Referring now to FIG. 6, the coupling member 38 may rotatably coupled to the track 48 to facilitate the rotation of the club alignment element 30 about the lateral axis ("y") discussed above. The track 48 may be curved and may match the curvature of the coupling member to permit the rotation of the club alignment element 30 along an arcuate path. As shown in FIG. 6, the track 48 may include a rail 58 engageable with a groove 60 defined by the coupling member 38. The rail 58 allows the coupling member 38 to slide about the track 48 to achieve a desired face angle. Although not shown in the figures, the track 48 optionally may include one or more detents that facilitate the club alignment element 30 to lockingly engage with the groove 60 at particular face angle location. For example, four detents may be included on the track 48 to correspond to two face angle locations to the right and left of center. Each detent locks the club alignment element 30 at the particular face angle location until a radial force is applied to the club alignment element 30 to urge the club alignment element 30 to a new face angle.

Figure 7:
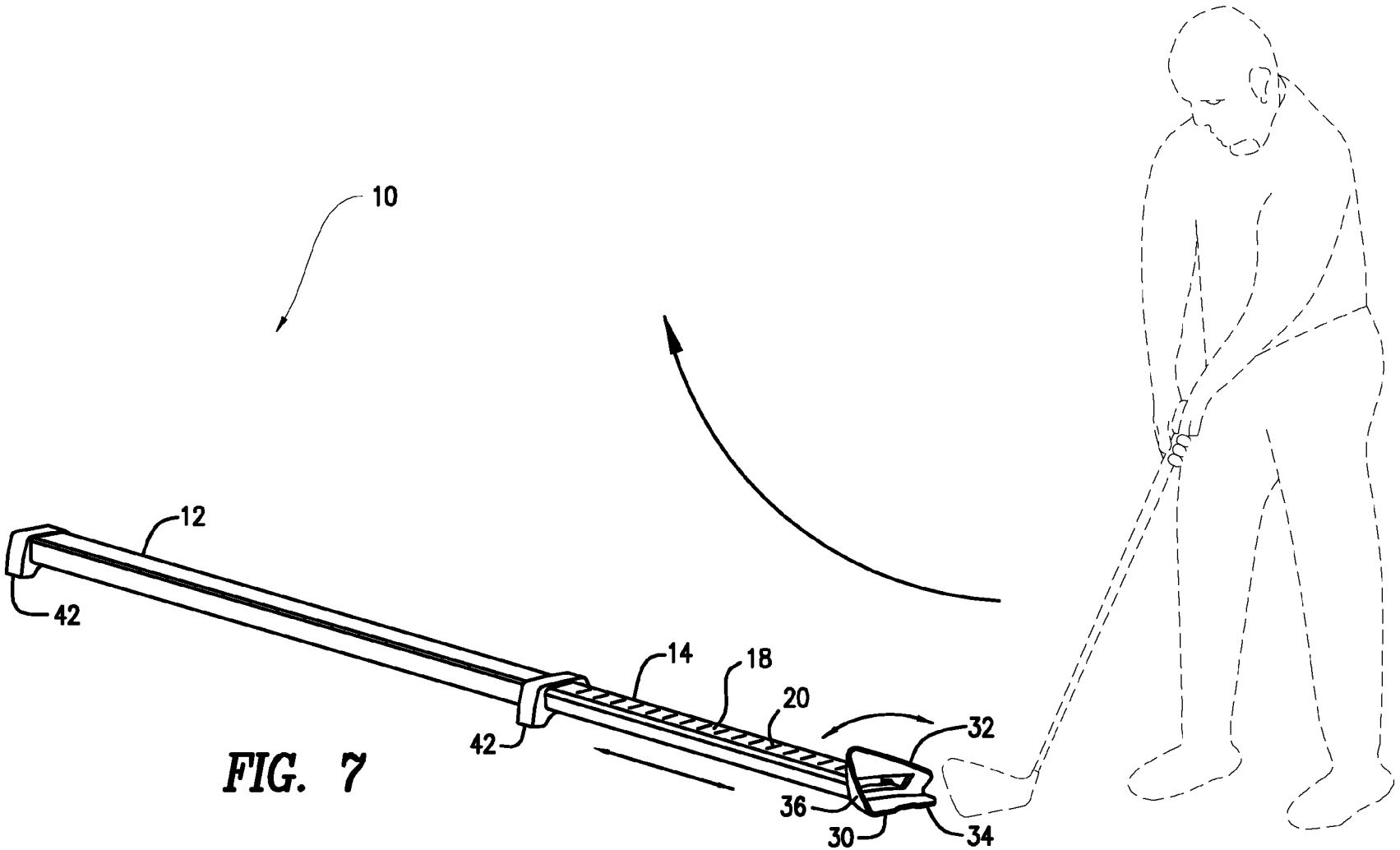
FIG. 7 is a top perspective view of the assembled embodiment of the golf backswing training device shown in FIG. 1 with a golfer and a golf club positioned adjacent the device.
Figure 8:
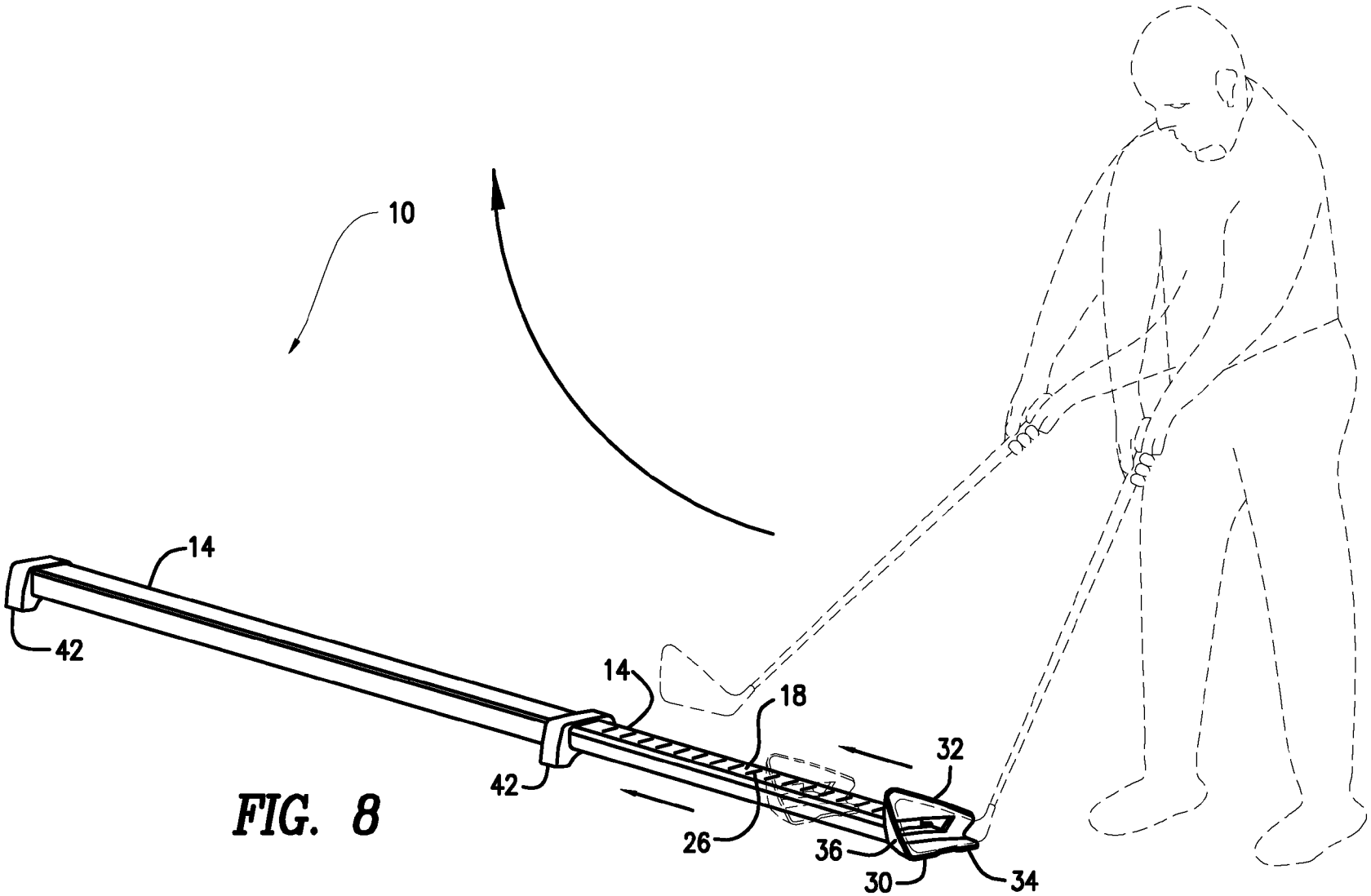
FIG. 8 is a side perspective view of the embodiment of the golf backswing training device shown in FIG. 7 showing a second portion of the device sliding within a first portion of the device in response to a force applied by a golf club during a golf backswing.

Referring now to FIGS. 7 and 8, in an exemplary use of the device 10, a golfer may position the device 10 on the ground or other surface. The golfer may slide the second elongate portion 14 with respect to the first elongate portion 12 such that the first end 22 the second elongate portion 14 is a distance away from the first end 16 of the first elongate portion 12. The golfer may position the club head of the golf club within the cavity 40 of the club alignment element 30 such that the first club contact surface 32 is in contact with the club head portion. The golfer may further place the club head portion in contact with the second club contact surface 34 such that a portion of the club head is substantially flush with the substantially flat portion 54. Should the golfer desire to change the face angle of the club head while maintaining contact with the first club contact surface 32, the golfer may rotate the club alignment 30 to the left or right of center to a desired face angle. As shown in FIG. 8, as the golfer draws the club backward toward the first end 16 of the first elongate portion 12, the second elongate portion 14 slides a distance toward the first end 16 based on the amount of forced applied to the club alignment element 30. The distance markers 26 indicate the displacement of the second elongate portion 14 with respect to the first elongate portion 12. Moreover, a golfer may determine the particular distance the club alignment element 30 is displaced to indicate a proper golf backswing. For example, a distance of 10 inches displaced by the second elongate portion 14 with respect to the first elongate portion 12 may indicate a proper backswing, whereas a distance of 6 inches may indicate the club head was not properly aligned within the club alignment element 30 or the golfer did not execute a proper swing to achieve the desired displacement. Optionally, the device 10 may be used with alignment rods to establish the proper positioning of the ball relative to the club head. For example, a first alignment rod (not shown) may be positioned parallel to the first elongate rod 12. A second alignment rod (not shown) may be placed perpendicular, or at 45 degree angle, to the first alignment rod in order to establish a consistent ball position or foot alignment.

In an exemplary configuration, if the club head is not properly positioned within the club alignment element 30 such that the club head is substantially flush with the first contact surface 34 when the club head is drawn backward toward the first end 20 of the first elongate portion 12, the second elongate portion 14 may slide less than a desired distance to indicate a proper golf swing. For example, when a 7 iron golf club head is positioned against club alignment element 30, by establishing and maintaining contact with the sidewall 36 and the first club contact surface 34, the golf shaft may lean toward the intended target. This shaft lean is built in by all club manufactures for their irons to facilitate the user's hands are positioned ahead of the club head. The shaft lean may result in the shaft being angled closer to the golfer's lead leg. When a golfer uses the device 10 with an incorrect shaft lean, the golf club head may not be in flush contact with the first club contact surface 34, which may indicate improper positioning of the club head within the club alignment element 30.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A golf backswing training device, comprising:

a first elongate portion defining a first major axis;

a second elongate portion slideably engageable with the first elongate portion, the second elongate portion defining a second major axis, a first end, and a second end; and a club alignment element coupled to the first end of the second elongate portion, the club alignment element having:

a first club contact surface disposed at an acute angle with respect to the second major axis;

a second club contact surface extending longitudinally from the first club contact surface;

a sidewall; and the first club contact surface, the second club contact surface, and the sidewall cooperate to define a cavity.

2. The device of claim 1, wherein the club alignment element is movable about the first end of the second elongate portion.

3. The device of claim 1, wherein the club alignment element is rotatable about an axis normal to the second major axis.

4. The device of claim 1, wherein the club alignment element is lockingly rotatable about an arcuate path.

5. The device of claim 1, wherein the first elongate portion defines a first end, a second end, and a passage therein, and wherein the second elongate portion is slideably receivable within the passage.

6. The device of claim 1, wherein the first club contact surface is disposed at an acute angle with respect to an axis lateral to the second major axis.

7. The device of claim 1, wherein the second elongate portion defines a top surface, and wherein the top surface includes a plurality of indicia.

8. The device of claim 1, wherein the first elongate portion includes a support element.

9. The device of claim 8, wherein the support element is adjustable in height.

10. The device of claim 1, wherein the first club contact surface includes a substantially flat portion and a curved portion.

11. A golf backswing training device, comprising:

a first elongate portion defining a passage therein, a first major axis, a first end, and a second end;

a second elongate portion slideably receivable within the interior of the first elongate portion, the second portion defining a first end, a second end, and a second major axis substantially co-axial with the first major axis when the second elongate portion is receive within the passage;

a club alignment element movably coupled to the first end of the second elongate portion, the club alignment element including a first contact surface disposed at an acute angle with respect to the second major axis; and the second portion being slideable from a first position in which the club alignment element is a distance away from the first end of first elongate portion to a second position in which the club alignment element is adjacent the first end of the first elongate portion.

12. The device of claim 11, wherein the club alignment element rotates about an axis normal to the second major axis.

13. The device of claim 11, wherein the club alignment element is lockingly rotatable about an arcuate path.

14. The device of claim 11, wherein the club alignment element includes a second club contact surface extending longitudinally from the first club contact surface and a sidewall, and wherein the first club contact surface, the second club contact surface, and the sidewall cooperate to define a cavity.

15. The device of claim 11, wherein the second elongate portion defines a top surface, and wherein the top surface includes a plurality of indicia.

16. The device of claim 11, wherein the first club contact surface is disposed at an acute angle with respect to an axis lateral to the second major axis.

17. The device of claim 11, wherein the first elongate portion and the second elongate portion are substantially rectangular in shape.

18. The device of claim 11, further including a support element coupled to the first elongate portion, the support element being adjustable in height.

19. The device of claim 11, wherein the first club contact surface includes a substantially flat portion and a curved portion.

20. A golf backswing training device, comprising:

a first elongate portion defining a first major axis, a first end, a second end, and a passage therein;

a second elongate portion slideably receivable within the passage, the second portion defining a first end, a second end, and a second major axis substantially co-axial with the first major axis when the second elongate portion is receive within the passage;

a club alignment element rotatably coupled to the first end of the second elongate portion, the club alignment element being lockingly rotatable about an arcuate path, the club alignment element including a first club contact surface extending disposed at an acute angle with respect to the second major axis; the club alignment element further including a second club contact surface extending longitudinally from the first club contact surface, the second club contact surface defining a longitudinal axis substantially parallel to the first major axis and the second major axis;

the second portion being slideable from a first position in which the club alignment element is a distance away from the first end of first elongate portion to a second position in which the club alignment element is adjacent the first end of the first elongate portion; and a support element coupled to the first elongate portion, the support element being adjustable in height.

* * * * *